US005842390A

United States Patent [19]

Bouligny et al.

[11] Patent Number: 5,842,390

[45] Date of Patent: Dec. 1, 1998

[54] DUAL STRING BACKUP TONG

[75] Inventors: Vernon Bouligny; Mark Veverica, both of Lafayette, La.

[73] Assignee: Frank's Casing Crew and Rental Tools Inc., Lafayette, La.

[21] Appl. No.: 608,079

[22] Filed: Feb. 28, 1996

[51] Int. Cl.[6] ..... B25B 13/50

[52] U.S. Cl. ..... 81/57.34; 81/57.33

[58] Field of Search ..... 81/57.33, 57.34, 81/57.35, 57.36, 57.15, 57.16, 57.24

[56] References Cited

U.S. PATENT DOCUMENTS

| | | | |
|---|---|---|---|
| Re. 31,699 | 10/1984 | Eckel | 73/862.25 |
| 2,846,909 | 8/1958 | Mason | 81/53 |
| 2,989,880 | 6/1961 | Hesser et al. | 81/53 |
| 3,196,717 | 7/1965 | Sheppard | 81/57 |
| 3,371,562 | 3/1968 | Kelley | 81/54 |
| 3,703,111 | 11/1972 | Guier | 81/57.34 |
| 4,246,809 | 1/1981 | Keast | 81/57.16 |
| 4,334,444 | 6/1982 | Carstensen | 81/57.18 |
| 4,357,843 | 11/1982 | Peck et al. | 81/57.16 |
| 4,402,239 | 9/1983 | Mooney | 81/57.16 |
| 4,492,134 | 1/1985 | Reinboldt | 81/57.34 |
| 4,574,664 | 3/1986 | Curry | 81/57.34 |
| 4,590,823 | 5/1986 | Neves et al. | 81/57.14 |
| 4,648,292 | 3/1987 | Haynes et al. | 81/57.34 |
| 4,732,061 | 3/1988 | Dinsdale | 81/57.34 |
| 4,747,588 | 5/1988 | Dillhoff | 81/418 |
| 5,060,542 | 10/1991 | Hauk | 81/57.34 |
| 5,644,960 | 7/1997 | O'Brien | 81/367 |

OTHER PUBLICATIONS

Weatherford International, Inc., *Weatherford Dual Completion Tong*, 1990.

*Primary Examiner*—David A. Scherbel
*Assistant Examiner*—Joni B. Danganan
*Attorney, Agent, or Firm*—Matthews, Joseph, Shaddox & Mason, P.L.L.C.; Henry L. Ehrlich

[57] ABSTRACT

A backup tong having an inner throat sized to accommodate a second pipe string while a first pipe string is held within the jaws of the tong is disclosed. The inventive backup tong facilitates operations on dual pipe strings by allowing the tong to grip not only the closer of two pipe strings, but also the farther of the pipe strings by allowing the nearer pipe string to reside in an inner throat of the backup tong, between the gripping members of the tong and the body of the backup tong, while the farther pipe string is held between the gripping members. The inventive backup tong thereby allows the operator to grip either of the pipe strings from a single side, eliminating the side-to-side movement (and corresponding time and risk of harm) which is required when using prior art backup tongs.

5 Claims, 4 Drawing Sheets

DUAL STRING BACKUP TONG

FIELD OF THE INVENTION

The present invention relates generally to tools used in oilfield operations and more particularly to a backup tong suitable for use in dual tubing strings operations in conjunction with a power tong to make up or break apart joints of pipe strings.

BACKGROUND OF THE INVENTION

Tongs have long been used in oilfield operations to grip and rotate pipe segments and thereby "make up" or "break apart" joints in a pipe string. A backup tong is used to grip and prevent rotation of the lower pipe in the joint while the upper pipe segment is gripped and rotated by a second tong. Typically, this second tong is not manually used to rotate the upper pipe, but is instead power-driven. Backup tongs are thus used only in conjunction with a second tong, whether the second tong be manually operated or actually "powered."

Tongs are generally designed to operate only on a single string of pipe. In other words, they are designed to grip and/or rotate a single pipe without regard to whether there may be any other pipes nearby, much less within the same wellbore. In a situation in which there are two pipe strings in the same casing, the tongs may be used if the strings are sufficiently far apart to allow access to each string or the two strings may be "splayed" apart to make room to engage the tongs. Even if the tongs can be used with dual tubing strings (with or without splaying the pipe strings), the tongs must be used on the first (the nearest) of the two pipe strings, then backed off, moved to the opposite side of the pipe strings and then moved onto the second pipe string, which after moving the tongs becomes the nearer of the two. The movement of the tongs back and forth from one side of the tubing strings to the other takes a great deal of time and creates a much greater risk of harm to the tong operator than when the tongs are simply moved forward or backward onto or off of a single pipe string. The use of prior art tongs (which are designed for use in single string operations) is therefore troublesome and time consuming in situations where there are two or even three pipe strings.

Although this disclosure relates to backup tongs, the scope of the problem is also apparent from the shortcomings of prior art power tongs. U.S. Pat. No. 4,590,823 to Neves, et al. shows an open-throat power tong which allows one pipe string to be gripped while the adjacent string is positioned within the outer throat of the tong (i.e., the opening between the gripping mechanism of the tong and the exterior of the tong). While Neves, et al. discloses a type of power tong which can be used with dual pipe strings, it does not disclose any way to overcome the problem of having to move the power tong, or a backup tong used therewith, from side to side to properly position the first and second pipe strings between the jaws of the tong and in the throat of the tong, respectively.

Backup tongs, like power tongs, are typically designed for use in single string operations. As noted above, some designs of backup tongs may be used in dual string operations by utilizing an open throat design which can accommodate a second pipe in the outer throat of the tong while gripping a first pipe string between its jaws. While this method of using a backup tong is known in the art, it requires that the backup tong be used on a first string, then backed off of the first string, moved approximately 180 degrees to face the second pipe string and then moved forward to engage the second pipe string. Although this procedure makes dual string operations possible with backup tongs designed to operate on a single string, the extra movement is time consuming and inefficient and poses a much greater risk of injury than a tong which does not have to be repeatedly swung around the pipe strings.

SUMMARY OF THE INVENTION

The shortcomings of the devices in the prior art are overcome in the present invention by providing a backup tong which does not need to be backed off of a first pipe string, swung around to the opposite side of the string and engaged with a second pipe string from the opposite direction. This is accomplished by placing the gripping members of the backup tongs at the end of a set of extended jaw members which have an inner throat between the gripping members and the main body of the backup tong. This inner throat is directly adjacent to the pipe which is gripped by the jaws of the backup tong and is on the side of the pipe opposite the outer throat, through which the pipe passes as the tong is moved onto the pipe. This allows the invention to grip the further of two strings while the nearer string is within the inner throat of the backup tong, then release the far string, move back and grip the near string. Likewise, in backout mode, the inventive tong can grip the nearer of two pipe strings as a conventional backup tong would, then simply release the first string and move forward to grip the second string while the first string is disposed in the inner throat of the backup tong. The inner throat of the tong can also be designed to accommodate three pipe strings, although three-string operations (one string in the jaws of the tong and two strings in the inner throat) are rarely conducted. Obviously, the invention has utility in single-string operations as well.

The ability to conduct dual string operations with minimal movement of the backup tong greatly reduces the time required to make or break the joints of dual pipe strings. This in turn provides increased efficiency, reduced costs and greater safety for persons operating the tongs.

It is therefore an object of the invention to provide a backup tong which can accommodate a second pipe on either side of a first pipe which is held between the jaws of the backup tong and thereby allows the tong to grip either pipe with only a small lateral movement.

It is another object of the invention to provide a backup tong which reduces the time, effort and related expense to make up and break apart pipe joints in multiple-string operations.

It is another object of the invention to provide a backup tong which reduces the risk of harm to the tong operator by minimizing the movement of the backup tong during its use in multiple-string operations.

DETAILED DESCRIPTION OF THE PREFERRED EMBODIMENT

Figure 1:
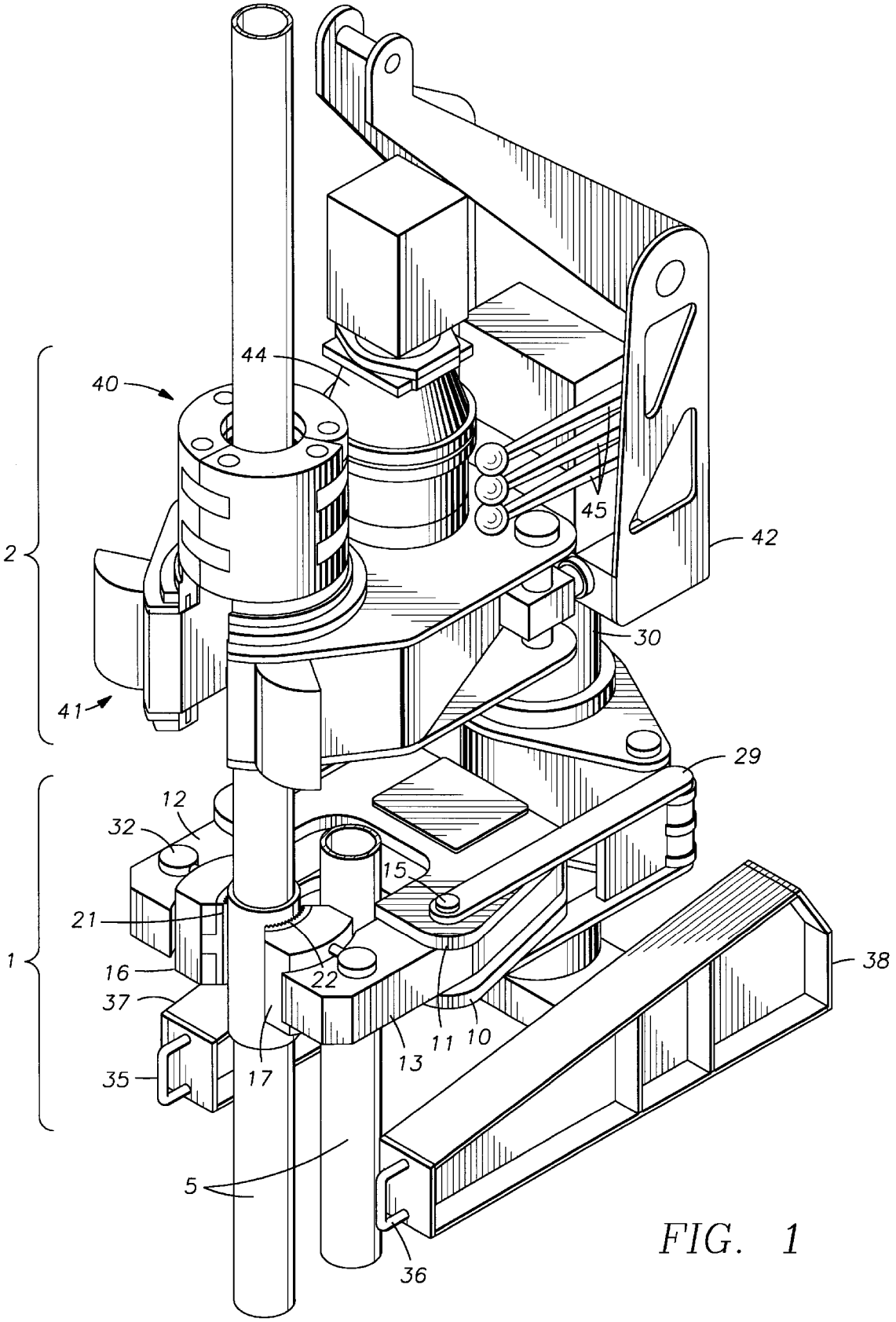
FIG. 1 is a perspective view of one embodiment of the inventive backup tong in use, with a pipe disposed in the inner throat of the tong.

Referring to FIG. 1, one embodiment of the backup tong of the present invention is shown. The body of the backup tong has an upper plate 11 and a lower plate 10. Between these plates are two jaw members 12, 13 which pivot about bolts 14, 15. At the outer ends of the jaw members 12, 13 are gripping members 16, 17. Gripping members 16, 17 carry dies 21, 22 which actually come into contact with and grip a pipe which is situated between them. A hydraulic actuator (not shown) is disposed between the jaw members and connected to these members at their inner ends (the ends opposite gripping members 16, 17). As the hydraulic actuator forces the non-gripping ends of the jaw members outward, the jaw members pivot around bolts 14, 15 and force gripping members 16, 17 inward. Likewise, when the actuator pulls jaw members 12, 13 inward, the pivoting of the jaw members forces gripping members 16, 17 outward.

Although this embodiment utilizes the two pivoting jaw members, this is considered a design choice and may be replaced in the invention by a wide variety of jaw designs which are known in the art. These jaw designs may incorporate pivoting jaw members, stationary jaw members with laterally movable gripping members, or any other arrangement of jaw members and/or gripping members which allows the incorporation of an inner throat into the tong design.

Figure 4:
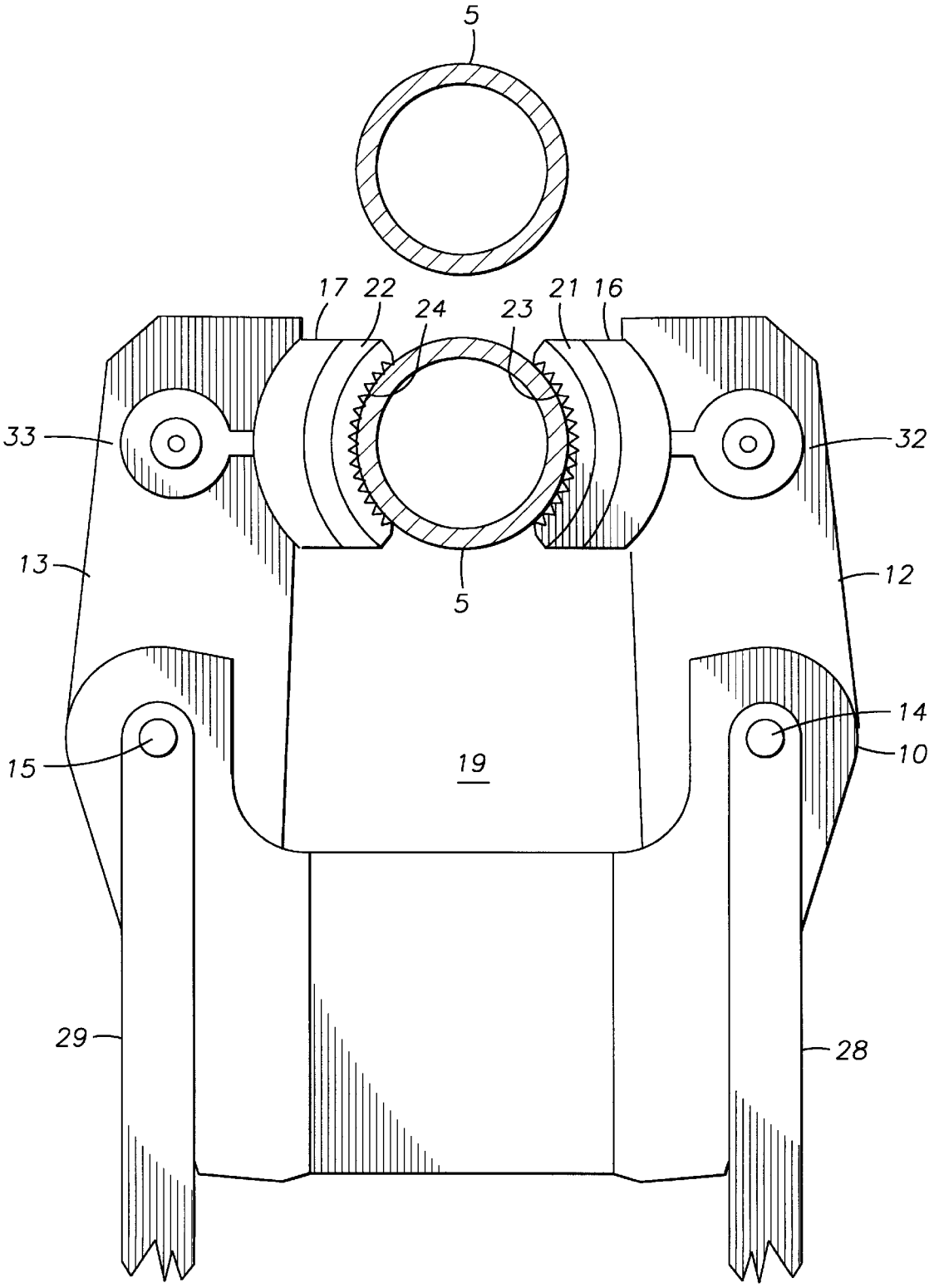
FIG. 4 is a top view of one embodiment of the inventive backup tong with no pipe disposed in the inner throat of the tong.

The backup tong assembly shown in FIG. 4, and particularly upper plate 11 and lower plate 10, is formed with an inner throat or recess 19 immediately behind gripping members 16, 17 (i.e. between gripping members 16, 17 and plates 10, 11). Because recess 19 is disposed between pivot bolts 14 and 15, jaw members 12, 13 essentially pivot around the recess so that a pipe string disposed within the recess is not disturbed by operation of the backup tong.

Figure 2:
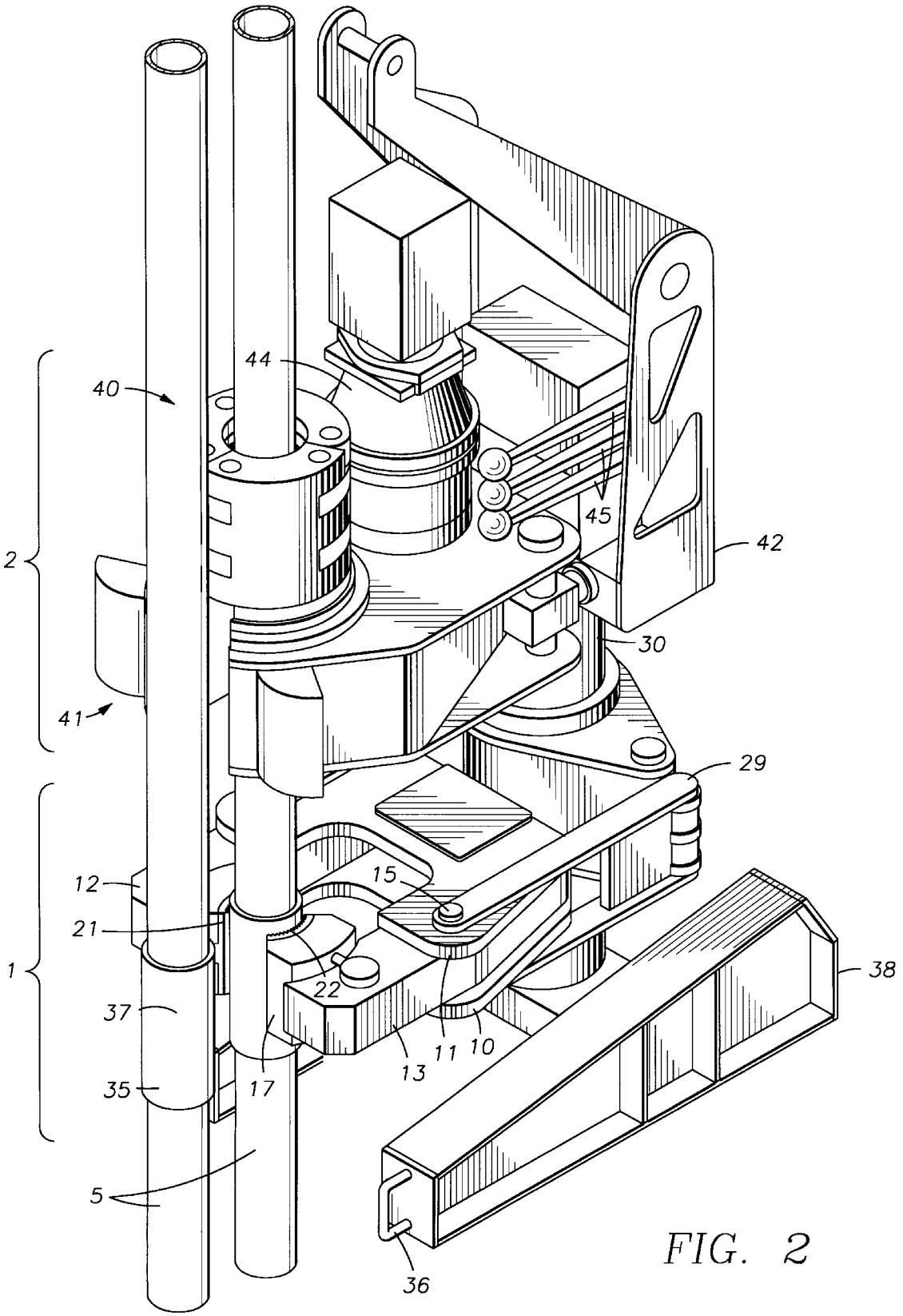
FIG. 2 is a perspective view of one embodiment of the inventive backup tong in use, with no pipe disposed in the inner throat of the tong.

The preferred embodiment of the invention is used in conjunction with a power tong. In FIGS. 1 and 2, the invention is shown mounted to a torque post 30. The invention is mounted on the torque post by means of two pivoting arms 28, 29 which allow the invention to shift laterally with respect to a line extending from the center of recess 19 to a point midway between gripping members 16, 17. Also mounted on torque post 30 is a power tong 2 which is preferably capable of dual-string operations. The mounting of the backup tong 1 and the power tong 2 on the torque post prevents them from rotating with respect to each other.

Gripping members 16, 17 are pivotally connected to jaw members 12, 13. Pivot connections 32, 33 allow gripping members 16, 17 to have a small range of motion in the direction essentially perpendicular to the motion imparted to the gripping members through movement of jaw members 12, 13. The degree of freedom provided by pivot connections 32, 33 allows gripping members 16, 17 to accommodate a pipe therebetween and adjust their positions so that the faces 23, 24 of dies 21, 22 come fully into contact with the pipe.

In the preferred embodiment, the power tong 2 which is used with the inventive backup tong 1 is also capable of dual-string operations. FIG. 1 shows a closed-throat power tong which comprises a multi-sectioned gripping assembly 40 mounted on power tong body 41. Also mounted on power tong body 41 is drive motor 44. Contained within power tong body 41 is the drive mechanism (not shown) which transfers power from the drive motor 44 to the gripping assembly 40, causing the gripping assembly to rotate. The operation of the drive mechanism and the rotation of the gripping assembly are regulated by controls 45. The physical positioning of the backup tong and power tong are facilitated by structural arms 37, 38 which are rigidly connected to torque post 30 structural arms 37, 38 have handles 35, 36 which allow the tong operator to grasp and position the backup and power tongs.

The power tong body 41 is mounted to power tong frame 42. Power tong frame 42 is in turn connected to the upper portion of torque post 30. As mentioned above, the attachment of both power tong 2 and the inventive backup tong 1 to torque post 30 prevents the tongs from rotating relative to each other. The torque between these two components is therefore transferred to the pipe and coupling which are held by the power tong and backup tong, respectively.

Figure 3:
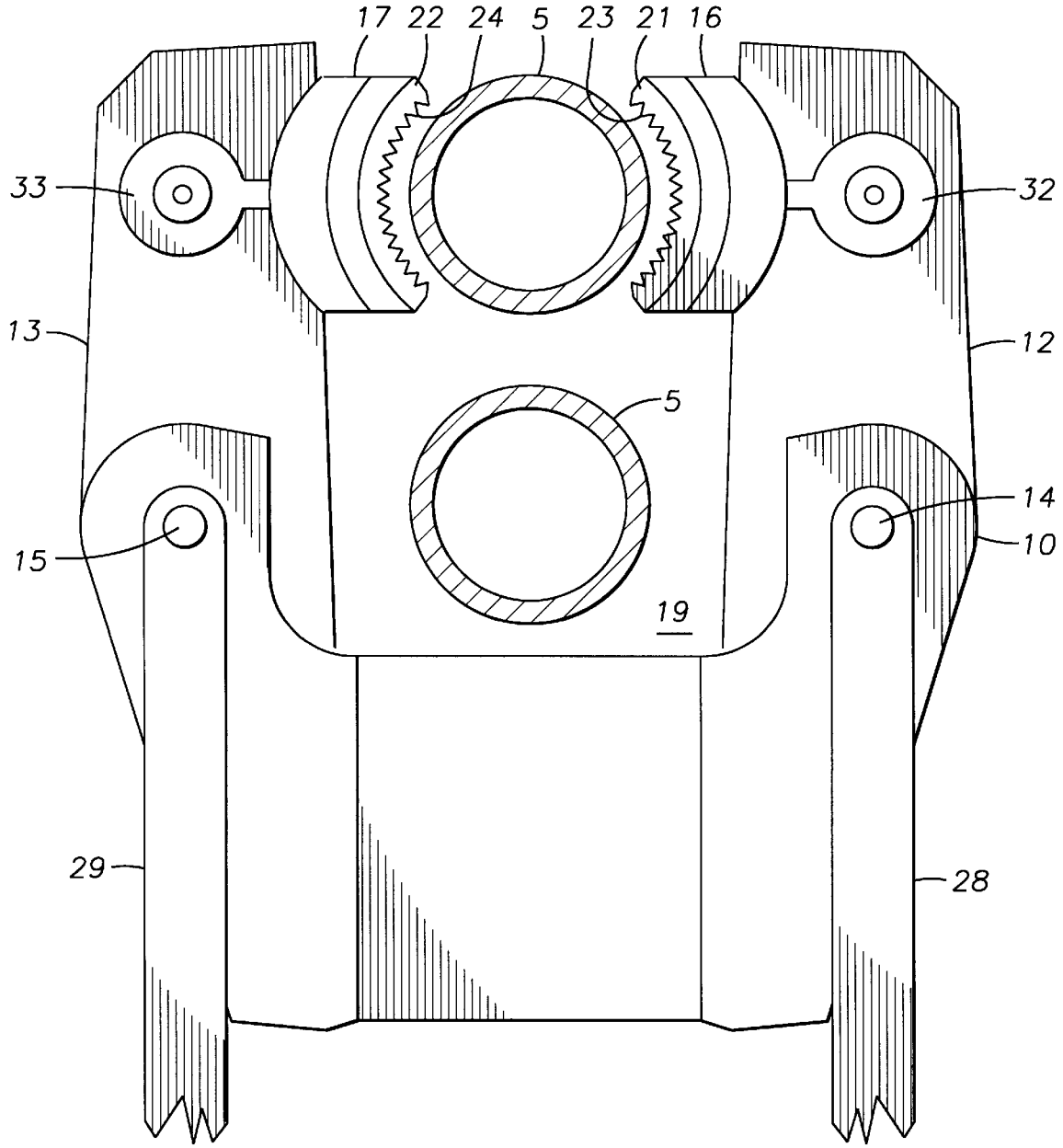
FIG. 3 is a top view of one embodiment of the inventive backup tong with a pipe disposed in the inner throat of the tong.

Referring to FIGS. 1 and 3, it can be seen that the present invention can operate on dual pipe strings without having to move the backup tongs from one side of the dual pipe strings to the other, as is the case with prior art backup tongs. Both the invention, and conventional single-string backup tongs can be positioned to grip the closer of a pair of adjacent pipe strings in the same way (see FIGS. 2 and 4). In order for a conventional backup tong to grasp the second (the farther) of the pipe strings, the tong must be backed off the near string, moved to the opposite side of the pair of pipe strings so that the second string is the nearer of the two, and moved forward to engage the pipe string. In other words, the conventional tong can only engage the nearer of the two pipes, so it must be repositioned on the opposite side of the dual strings before it can engage the second pipe.

The invention, on the other hand, simply releases the first string, moves forward several inches so that the first pipe string is within the throat of the tong, and grips the second pipe string. The inventive tong can, of course, also initially grip the second pipe string while the first pipe string is within the inner throat of the tong, then release the second string, move backward and grip the first string. No time or effort is wasted in having to move the backup tong from one side of the pair of pipe strings to the other—the tong is simply shifted forward or backward several inches. (It does not matter which of the two pipes is gripped first or second by the tong.)

The foregoing describes the use of the invention with two pipe strings. The invention nevertheless has application to operations which utilize more than two pipe strings, although these operations are somewhat rare. In such cases, the throat of the invention need only be enlarged to accommodate the additional pipe strings.

While the preferred embodiment utilizes a body (formed by upper and lower plates 11, 10) with two movable jaw members, the arrangement of the body, jaw members and other components is not essential to the invention. The practice of the invention requires the use of a gripping mechanism in conjunction with recesses or spaces which allow a second pipe to reside adjacent to a first pipe on either of two substantially opposite sides of a first pipe held by the gripping mechanism. The gripping mechanism may use more or less than two movable members, it may use hydraulic, mechanical or other types of actuators, it may use pivoting or non-pivoting members, and so on. Many such modifications to the design of the invention will be obvious to a person of ordinary skill in the art and, although these alternate embodiments of the invention are not expressly described herein, they are contemplated by the invention and are within the scope of this disclosure.

Many modifications can be made to the preferred embodiment and numerous resulting alternate embodiments of the invention can be designed without departing from the scope of the invention. The specific embodiments disclosed herein are exemplary and other embodiments will be obvious from this disclosure to those skilled in the art.

What is claimed is:

1. A method for using a backup tong to grip adjacent pipe strings in multiple-tubing subterranean wellbore operations without having to substantially change the position of the backup tong, comprising the steps of:

providing a backup tong having a pair of jaws, each of which has a gripping end, the jaws being movable with respect to each other and an inner throat formed between the jaws and interior of the gripping ends, the inner throat being sized to accommodate a second pipe therein while a first pipe is held between the gripping ends of the jaws;

positioning the backup tong so that a first pipe string is between the gripping ends of the jaws and a second pipe string is disposed within the inner throat moving the jaws of the backup tong to engage the gripping ends with the first pipe string; and providing a power tong connectable to a portion of said pipe string engaged by said gripping ends for rotating a portion of said pipe string to make-up or break a portion of said pipe string.

2. The method of claim 1, further comprising the steps of:

moving the jaws out of engagement with the first pipe string;

moving the backup tong in a direction from the first pipe string toward the second pipe string until the second pipe string is between the gripping ends of the jaws of the backup tong while maintaining the orientation of the backup tong;

moving the jaws of the backup tong to engage the gripping ends with the second pipe string; and connecting said power tong to a portion of said second pipe string engaged by said gripping ends for rotating said portion of said string not gripped for making-up or breaking said second pipe string.

3. A backup tong for gripping a portion of a pipe string in a multiple pipe string operation while allowing a second pipe string to be positioned within the backup tong without necessitating splaying of the pipe strings, the backup tong comprising:

a body;

two jaws connected to the body and movable with respect to each other, each said jaw having a gripping end for gripping a portion of a first pipe string;

an inner throat formed between said body, said jaws, and said gripping ends of said jaws, said inner throat adapted for disposing a portion of a second pipe string therein when said gripping ends are gripping a portion of said first pipe string; and a power tong connected to said body and connectable to a portion of said pipe string gripped by said gripping ends for rotating said pipe string portion relative to said pipe string portion gripped by said gripping ends.

4. The backup tong of claim 3 further comprising:

a gripping member pivotally attached to said gripping end of each said jaw for engaging said pipe.

5. The backup tong of claim 3 wherein:

each said gripping member includes a pair of dies, each said die being disposed for engaging said pipe when said jaws are in a closed position.

* * * * *